United States Patent [19]

Erickson

[11] Patent Number: 4,783,209

[45] Date of Patent: Nov. 8, 1988

[54] CRYOGENIC AIR DISTILLATION WITH COMPANDED NITROGEN REFRIGERATION

[76] Inventor: Donald C. Erickson, 1704 So. Harbor La., Annapolis, Md. 21401

[21] Appl. No.: 881,230

[22] Filed: Jul. 2, 1986

[51] Int. Cl.[4] ..... F25J 3/04

[52] U.S. Cl. ..... 62/22; 62/39

[58] Field of Search ..... 62/11, 22, 38, 39

[56] References Cited

U.S. PATENT DOCUMENTS

| | | | |
|---|---|---|---|
| 2,666,303 | 1/1954 | Schuftan | 62/39 |
| 3,677,019 | 7/1972 | Olszewski | 62/38 |
| 3,696,637 | 10/1972 | Ness et al. | 62/38 |
| 4,274,850 | 6/1981 | Becker | 62/38 |
| 4,388,108 | 7/1982 | Isalski et al. | 62/22 |
| 4,451,275 | 5/1984 | Vines et al. | 62/39 |
| 4,533,375 | 8/1985 | Erickson | 62/22 |
| 4,563,203 | 1/1986 | Weiss et al. | 62/38 |

FOREIGN PATENT DOCUMENTS

| | | |
|---|---|---|
| 2854508 | 6/1980 | Fed. Rep. of Germany . |
| 756150 | 8/1980 | U.S.S.R. . |

*Primary Examiner*—Ronald C. Capossela

[57] ABSTRACT

Method and apparatus are disclosed for obtaining more refrigeration from a cold pressurized stream of nitrogen being expanded to discharge pressure, particularly in an air separation plant. Referring to FIG. 1, cold expansion in 1 is followed or preceded by warm compression in 2 of at least part of the same stream being expanded. The net result of reduced $N_2$ to expansion is more $LN_2$ reflux available to increase $O_2$ recovery, without import of additional power or substantial increase in capital cost.

20 Claims, 3 Drawing Sheets

CRYOGENIC AIR DISTILLATION WITH COMPANDED NITROGEN REFRIGERATION

TECHNICAL FIELD

Process and apparatus are disclosed for production of gaseous oxygen plus optional byproducts (argon and/or nitrogen) and optionally including a minor amount of liquid product for oxygen purities from below 90% to above 99.5% and for high $O_2$ recoveries. The invention results in improved recovery of product and/or byproduct because more work and resulting refrigeration is obtained from the nitrogen routed to the refrigeration expander, while no additional power import is required and no substantial increase in capital expenditure is required. This leaves more liquid $N_2$ reflux available for increasing recovery than would be possible in the absence of the invention. The invention is appropriate for large-scale tonnage oxygen-producing plants such as those found in industrial applications.

BACKGROUND ART

In the classical dual pressure process for air distillation, cooled air is supplied to a high pressure rectifier. The HP rectifier overhead reboils the bottom of a lower pressure nitrogen removal column, and also evaporates the oxygen product. The rectifier liquid products are routed to the LP column--kettle liquid as feed, and $LN_2$ as overhead reflux (directly injected). The required process refrigeration may be obtained by either of two approximately equivalent methods: work expansion of part of the supply air to an appropriate height of the LP column, or work expansion of part of the HP rectifier overhead $N_2$ to exhaust pressure (approximately the LP column overhead pressure).

The recovery of $O_2$ is determined by the ability of the $LN_2$ reflux at the LP column overhead to rectify $O_2$ out of the $N_2$ exhaust. For the classical process described above, there is more than adequate $LN_2$ reflux available even after satisfying refrigeration requirements to achieve very high $O_2$ recoveries, on the order of 98% or more. However, whenever any process enhancement is introduced in order to achieve increased byproduct recovery, increased purity, or reduced energy consumption, there is usually also a corresponding reduction in the $LN_2$ available for reflux, and hence a decrease in $O_2$ recovery.

For example, $LN_2$ coproduct or pressurized $GN_2$ coproduct obviously cause a mole-for-mole reduction in $LN_2$ reflux availability. Increasing the $O_2$ delivery pressure by LOXBOIL results in less air supplied to the HP rectifier, and hence less $LN_2$ available as reflux. LOX coproduct decreases the HP rectifier reflux, which is $LN_2$. Argon byproduct requires an auxiliary argon rectifying section of the LP column, which communicates at its bottom with the vapor and liquid streams of the LP column between the argon stripping section and nitrogen stripping section of the LP column. The argon rectifier is conventionally reboiled by exchanging latent heat with part of the kettle liquid. This raises the quality of the feed to the LP column, and hence increases the need for $LN_2$ reflux. As a final example, low-energy triple-pressure processes such as disclosed in U.S. Pat. Nos. 3,688,513, 4,507,134, and 4,578,095 also supply one part of the air to the HP rectifier, and gasify part of the kettle liquid, thereby decreasing the $LN_2$ reflux availability on two counts.

In summary many different hypothetical improvements to air separation end up being less advantageous than first supposed, or even disadvantageous, due to the reduction in $LN_2$ reflux availability and the resulting decrease in $O_2$ recovery. What is needed is a method or apparatus which makes more $LN_2$ reflux available than in conventional practice, without additional power requirement or excessive increase in equipment cost. That is one primary objective of the disclosed invention.

It is known to expand part of the supply air to produce refrigeration, and drive a warm end compressor with the expansion work. U.S. Pat. No. 2,666,303 discloses such an apparatus in which overhead $N_2$ from the LP nitrogen removal column is compressed, thereby lowering LP column pressure below atmospheric pressure. West German patent application No. 2854508 by Rohde, published 6/19/80, discloses such an apparatus wherein the warm compressor compresses the expansion air before cold expansion.

Other prior art references involving similar companders include U.S. Pat. Nos. 3,261,168, 4,133,662, and Russian Patent No. 756150.

It is known to warm HP rectifier overhead $N_2$ to near ambient pressure, compress it with an externally powered compressor, re-cool it, and expand it back to HP rectifier overhead pressure, thereby providing the relatively large amount of refrigeration necessary in liquefaction cycles. One example is U.S. Pat. No. 3,319,427. It is also known to use a warm-end compressor driven by the expander to pick up part of the external compression duty, as disclosed in U.S. Pat. No. 4,099,945.

It is known to boil liquid nitrogen in a latent heat exchanger at the overhead of the argon rectifying section of a dual pressure column (U.S. Pat. No. 3,729,943) and of a triple pressure column (U.S. Pat. No. 4,578,095).

None of the above prior art references addresses or solves the problem of providing increased $LN_2$ reflux and hence increased $O_2$ recovery in a flowsheet wherein a discharge stream of pressurized $N_2$ gas must be expanded for refrigeration.

DISCLOSURE OF INVENTION

In the disclosed solution to the above problem the pressurized nitrogen stream to be expanded and exhausted is caused to produce more refrigeration work by being warmed and then further compressed in a compressor powered by the $N_2$ refrigeration expander. After companding (both expansion and compression) the $N_2$ is discharged at approximately atmospheric pressure; this is necessary because otherwise, if the $N_2$ remained pressurized after companding, no net refrigeration would be accomplished unless an externally powered compressor were also incorporated. The present disclosure makes it possible to develop all required process refrigeration without the addition of an externally powered $N_2$ compressor, although such an addition is not excluded from this invention.

The disclosed invention, consisting of cold expansion and warm compression of an initially pressurized $N_2$ stream plus final exhaust at atmospheric pressure, results in about 20 to 30% more refrigeration being developed per mole of $N_2$ processed through the compander. The increase in specific refrigeration can be used to either decrease the total compander flow, making more $LN_2$ reflux available, or to make more refrigeration, thus allowing withdrawal of more liquid coproduct; or any combination.

It is possible to conduct either expansion or compression first, and to recycle all, part, or none of the $N_2$ back into the cold box after compression. These three embodiments plus the various tradeoffs applying to each are described below. In general any of the three embodiments may be used with any flowsheet using discharge of pressurized nitrogen to produce refrigeration, since none of the embodiment recycle $N_2$ to any part of the actual separation process such as the distillation columns.

BRIEF DESCRIPTION OF THE DRAWINGS

In FIG. 1*a*, cold expansion to below atmospheric pressure is followed by warm compression to atmospheric pressure, and no $N_2$ is recycled. In FIG. 1*b* cold expansion to approximately atmospheric pressure is followed by warm compression of only a minor fraction to expander inlet pressure, and only that fraction is recycled. In FIG. 1*c* warm compression occurs first, all the $N_2$ is recycled into the cold box, and then cold expanded to approximately atmospheric pressure.

BEST MODE FOR CARRYING OUT THE INVENTION

Figure 1A:
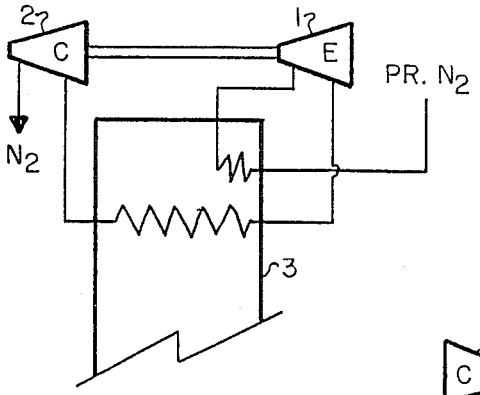
FIGS. 1*a*, 1*b*, and 1*c* illustrate the compander embodiments which extract additional work from a pressurized nitrogen stream being discharged to ambient pressure.

Referring to FIG. 1*a*, cold pressurized is initially superheated in sensible heat exchanger 3 at least sufficiently to preclude condensation during work-expansion, and then is work-expanded in cold expander 1, thereby depressurizing to below atmospheric pressure and also cooling the $N_2$. It is then heated to near ambient temperature by heat exchange with gases entering the cold box, and routed to the suction of warm compressor 2, which raises the pressure sufficiently for discharge to ambient. Warm compressor 2 is directly powered by cold expander 1. Heat exchanger 3 may be a single component or multiple cores, split streams, etc.

Figure 1B:
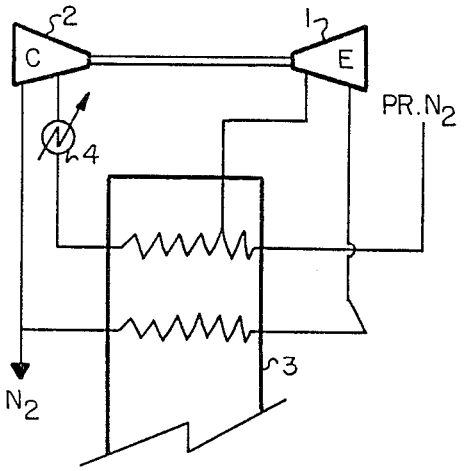

In FIG. 1*b*, the differences from FIG. 1*a* are that the $N_2$ is only depressurized to slightly above atmospheric pressure and only a minor fraction of the warm $N_2$ is compressed, but all the way up to expander inlet pressure, and the compressed fraction is cooled and combined with the cold pressurized $N_2$ to form the expander supply stream.

Figure 1C:
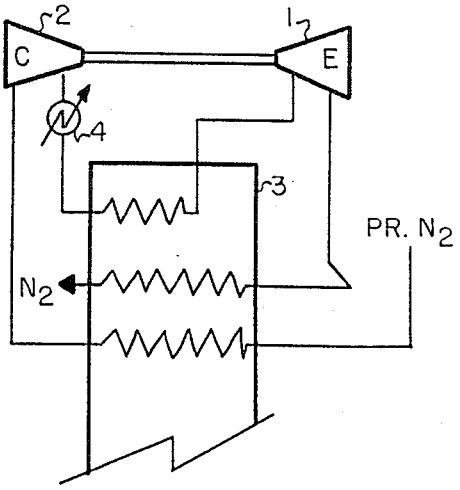
Figure 2:
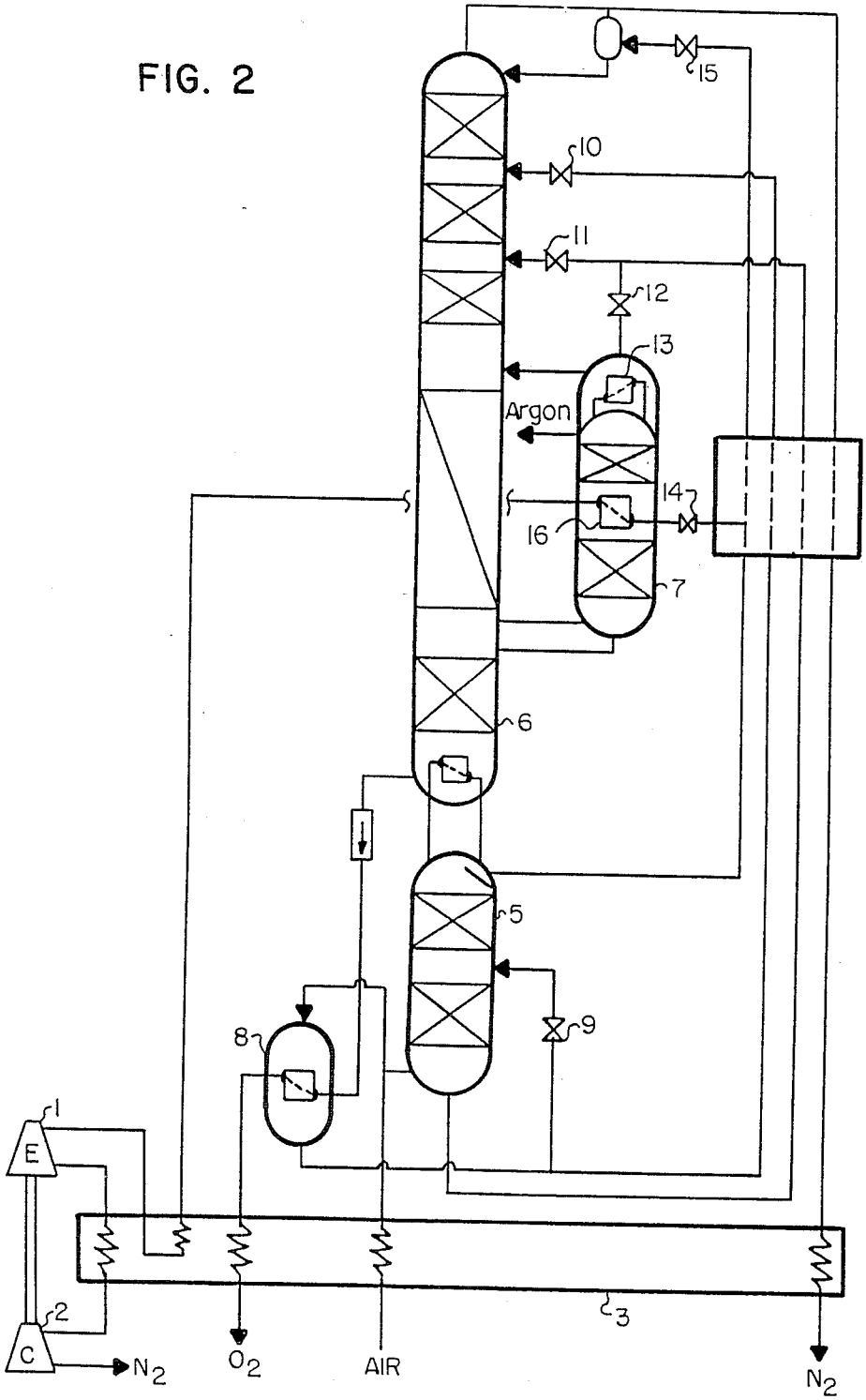
FIG. 2 illustrates the FIG. 1a embodiment as applied to a dual pressure high purity $O_2$ flowsheet incorporating increased argon recovery enhancements.
Figure 3:
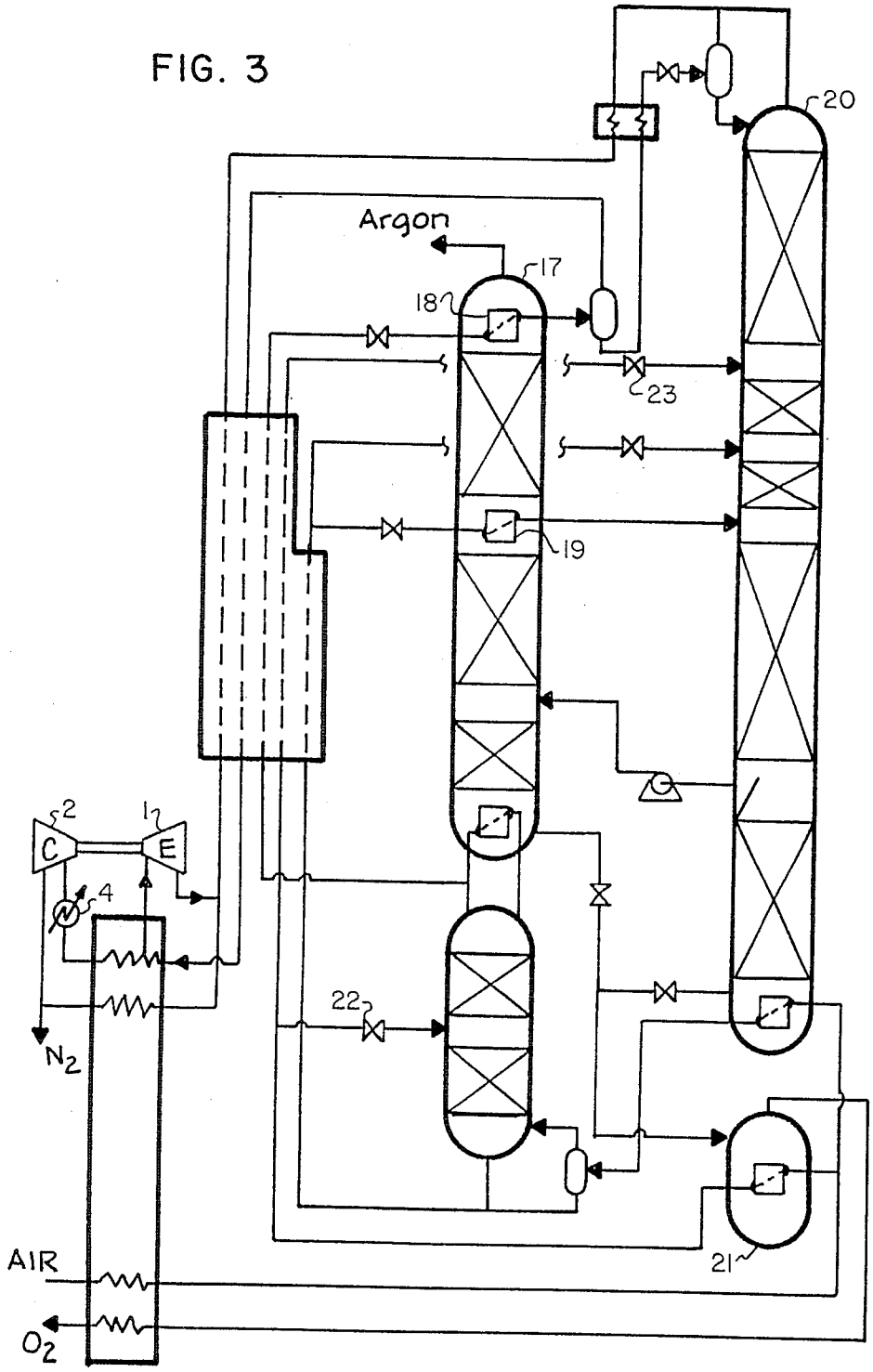
FIG. 3 illustrates the FIG. 1*b* embodiment as applied to a triple pressure low energy high purity $O_2$ flowsheet.

In FIG. 1*c*, the entire cold pressurized $N_2$ stream is warmed in 3 to near ambient, compressed in 2, cooled back to near-cold-box temperature, expanded in 1 to about atmospheric pressure, and discharged via 3. Whereas in many traditional flowsheets there is little difference between expanding air or nitrogen for refrigeration, in some advanced flowsheets for making high purity oxygen plus coproduct argon there is a significant difference. FIGS. 2 and 3 are examples. Traditional air expansion or HP rectifier $N_2$ expansion results in less reboil through the oxygen-argon stripper and also the argon rectifier, thus necessitating more stages and pressure drop to achieve high $O_2$ purity, and also decreasing the potential for argon recovery. If instead the expansion vapor is generated in the argon rectifier above the bottom, those problems are solved. Boiling liquid nitrogen is a preferred method of generating such vapor. The offsetting problem is that since the pressure of the $N_2$ vapor sent to expansion is appreciably lower than the HP rectifier overhead pressure, more $N_2$ is required, thus reducing $LN_2$ reflux. However, that problem is minimized in either or both of two ways: first, by companded expansion of the pressurized $N_2$ as disclosed herein; and second, by evaporating the $N_2$ at as high a pressure as possible, e.g., at an intermediate height of the argon rectifier.

FIG. 2 illustrates both of the above techniques, as applied to a dual pressure high purity plant. Supply air is processed conventionally through main exchanger 3, HP rectifier 5, LP $N_2$ removal column 6, including argon rectifier 7. LOX is gasified by total condensation of part of the feed air in 8, and the liquid air is split to intermediate reflux both rectifier 5 and column 6 via valves 9 and 10 respectively. Kettle liquid is split via valves 11 and 12, and part is evaporated in 13 to reflux the overhead of 7. HP rectifier overhead $LN_2$ is split by valves 14 and 15, part supplying indirect latent heat exchange reflux to column 7 via latent heat exchanger 16. The cold pressurized $N_2$ from 16 is the feed to the companded expansion device, expander 1 and compressor 2. Although the FIG. 1a embodiment is illustrated, it could equally well be the FIG. 1b or 1c embodiment. Also, exchanger 16 could alternatively be located at the top of rectifier 7 vice intermediate, with only small penalty. Other features illustrated in FIG. 2 are explained more fully in copending application Ser. No. 853,461 filed 04/18/86 by Donald C. Erickson, which is incorporated by reference.

Referring to FIG. 3, a low energy triple flowsheet similar to those in U.S. Pat. No. 4,578,095 is illustrated, except that in order to provide positive assurance against argon freezeup at the top of argon removal column 17, liquid $N_2$ is evaporated in latent heat exchanger 18 at a pressure sufficient to ensure temperatures above the argon freezing temperature, i.e., a pressure of about 31 psia or higher. The evaporated fraction is then routed to the companded $N_2$ expansion apparatus (expander 1 and compressor 2). Kettle liquid refluxes an intermediate height of 17 by latent heat exchanger 19; alternatively the column 17 intermediate liquid can directly exchange latent heat with $N_2$ removal column 20 intermediate vapor. FIG. 3 also illustrates total condensation LOXBOIL in 21 and liquid air split intermediate refluxing via valves 22 and 23. The companded expander is the partial recycle or FIG. 1*b* embodiment and hence may include cooler 4, although either other embodiment could also be used. Also, if other means are available to positively preclude argon freezeup, it would be desirable to interchange the locations of exchangers 18 and 19, so as to produce the pressurized $N_2$ at higher pressure.

Argon removal from 17 may be as vapor or liquid. A preferred technique is as liquid, using a barometric leg to increase the pressure well above atmospheric pressure before evaporation.

The basic disclosure of FIG. 1 obviously applies to the work-expansion of other cold pressurized gases besides $N_2$.

I claim:

1. A process for cryogenically distilling air to produce at least oxygen in an apparatus comprised of a high pressure rectifier and a low pressure $N_2$ removal column wherein the improvement comprises:

(a) producing the refrigeration required for said process by work-expanding a pressurized stream of nitrogen obtained from said process to a pressure no higher than the approximate pressure of the low pressure $N_2$ removal column;

(b) compressing at least part of said $N_2$ stream supplied to the expander, said compression step being at approximately ambient temperature; and (c) powering said compression by the work obtained from said expansion step.

2. Process according to claim 1 further comprising obtaining said $N_2$ stream being compressed by warming the $N_2$ discharged from said expander, and directing essentially all of it to said compressor inlet.

3. Process according to claim 1 further comprising obtaining said $N_2$ stream being compressed by warming the $N_2$ discharged from said expander, and directing only part of it to said compressor inlet; cooling said compressor discharge; and adding it to the expander inlet stream.

4. Process according to claim 1 further comprising obtaining said $N_2$ stream being compressed by warming a pressurized $N_2$ stream prior to expansion; and also comprising cooling said compressed stream; and then work-expanding said stream to the approximate LP column pressure.

5. Process according to claim 1 further comprising obtaining said $N_2$ stream from the overhead of said high pressure rectifier.

6. Process according to claim 1 wherein said low pressure $N_2$ removal column is further comprised of an auxiliary argon rectifying section, and further comprising obtaining said $N_2$ stream by evaporating liquid $N_2$ from said HP rectifier, which has been reduced in pressure, by exchanging latent heat with vapor from above at least part of the counter-current contacting section of said argon rectifier.

7. Process according to claim 1 further comprising providing a separate argon removal column at a pressure lower than said $N_2$ removal column pressure; and obtaining said $N_2$ stream by evaporating partially depressurized HP rectifier liquid $N_2$ by latent heat exchange with vapor from above the feed point of said argon removal column.

8. Apparatus for obtaining refrigeration from a cold pressurized nitrogen stream comprised of a cold nitrogen expander to produce work and refrigeration and a warm nitrogen compressor powered by said expander, wherein the improvement comprises:

(a) a conduit and a means for sensible heat exchange connecting said expander discharge to said compressor inlet;

(b) a means for directly discharging said compressor effluent; and (c) a means for partially warming said cold pressurized nitrogen enroute to said expander.

9. Apparatus according to claim 8 further comprising:

(a) high pressure rectifier; and (b) conduit including means for sensible heat exchange connecting said HP rectifier overhead vapor to said expander inlet.

10. Apparatus according to claim 8 further comprising:

(a) high pressure rectifier;

(b) low pressure $N_2$ removal column including auxiliary argon rectifying section;

(c) means for latent heat exchange between partially depressurized HP rectifier overhead liquid $N_2$ and vapor from the upper portion of said argon rectifier; and (d) conduit including means for sensible heat exchange for connecting said evaporated $N_2$ to the inlet of said expander.

11. Apparatus according to claim 8 further comprising:

(a) high pressure rectifier;

(b) low pressure $N_2$ removal column;

(c) lower pressure argon removal column;

(d) means for exchanging latent heat between partially depressurized liquid $N_2$ from said HP rectifier and vapor from the upper portion of said argon removal column; and (e) conduit including means for sensible heat exchange which conducts said evaporated $N_2$ to the inlet of said expander.

12. Apparatus for refrigerating cold nitrogen stream in cryogenic distillation of air compressed of cold nitrogen expander to produce work and refrigeration and warm nitrogen compressor powered by said expander, wherein the improvement comprises:

(a) conduit and means for sensible heat exchange connecting said compressor discharge and said expander inlet;

(b) conduit and means for sensible heat exchange for warming said expander effluent.

13. Apparatus according to claim 12 further comprising:

(a) high pressure rectifier; and (b) conduit including means for sensible heat exchange connecting said HP rectifier overhead vapor to said compressor inlet.

14. Apparatus according to claim 12 further comprising:

(a) high pressure rectifier;

(b) low pressure $N_2$ removal column including auxiliary argon rectifying section;

(c) means for latent heat exchange between partially depressurized HP rectifier overhead liquid $N_2$ and vapor from the upper portion of said argon rectifier; and (d) conduit including means for sensible heat exchange for connecting said evaporated $N_2$ to the inlet of said compressor.

15. Apparatus according to claim 12 further comprising:

(a) high pressure rectifier;

(b) low pressure $N_2$ removal column;

(c) lower pressure argon removal column;

(d) means for exchanging latent heat between partially depressurized liquid $N_2$ from said HP rectifier and vapor from the upper portion of said argon removal column; and (e) conduit including means for sensible heat exchange which conducts said evaporated $N_2$ to the inlet of said compressor.

16. Apparatus for cryogenic distillation of air comprised of cold nitrogen expander to produce work and refrigeration and warm nitrogen compressor powered by said expander, wherein the improvement comprises:

(a) means for combining a first $N_2$ stream obtained from said distillation apparatus with a second $N_2$ stream and routing said combined stream to said cold expander;

(b) means for warming said expander discharge to approximately ambient temperature;

(c) means for supplying a minor fraction of at least one of said warmed expander $N_2$ and the exhaust $N_2$ from said distillation apparatus to said warm compressor; and (d) conduit and means for sensible cooling connecting said compressor discharge to said means for combining.

17. Apparatus according to claim 16 further comprising (a) high pressure rectifier;

(b) low pressure $N_2$ removal column;

(c) means for associating the LP column overhead $N_2$ and the expander discharge $N_2$; and (d) means for sensible warming of the associated $N_2$ stream to near ambient temperature.

18. Apparatus according to claim 17 further comprising: conduit including means for sensible heat exchange connecting said HP rectifier overhead vapor to said means for combining.

19. Apparatus according to claim 17 further comprising:

(a) low pressure $N_2$ removal column including auxiliary argon rectifying section;

(b) means for latent heat exchange between partially depressurized HP rectifier overhead liquid $N_2$ and vapor from the upper portion of said argon rectifier; and (c) conduit including means for sensible heat exchange for connecting said evaporated $N_2$ to said means for combining.

20. Apparatus according to claim 17 further comprising:

(a) lower pressure argon removal column;

(b) means for exchanging latent heat between partially depressurized liquid $N_2$ from said HP rectifier and vapor from the upper portion of said argon removal column; and (c) conduit including means for sensible heat exchange which conducts said evaporated $N_2$ to said means for combining.

* * * * *